United States Patent [19]

McCall et al.

[11] Patent Number: 4,801,039

[45] Date of Patent: Jan. 31, 1989

[54] ANIMAL PROOF CONTAINER

[75] Inventors: Mark McCall, San Jose, Calif.; Jeffrey W. Vinson, Cave Creek, Ariz.

[73] Assignee: Netra Plastics, Mountain View, Calif.

[21] Appl. No.: 154,914

[22] Filed: Feb. 11, 1988

[51] Int. Cl.[4] ..... B65D 39/00

[52] U.S. Cl. ..... 220/284; 215/212; 215/215; 220/307; 220/323; 220/326

[58] Field of Search ..... 220/281, 284, 307, 323, 220/326; 215/207, 212, 213, 215, 302

[56] References Cited

U.S. PATENT DOCUMENTS

| | | | |
|---|---|---|---|
| 3,343,712 | 9/1967 | Lentz | 220/323 X |
| 3,633,787 | 1/1972 | Katz | 220/284 |
| 4,534,488 | 8/1985 | Boggs | 220/323 |

FOREIGN PATENT DOCUMENTS

| | | | |
|---|---|---|---|
| 2305362 | 10/1976 | France | 215/212 |

*Primary Examiner*—Donald F. Norton

*Attorney, Agent, or Firm*—Fliesler, Dubb, Meyer & Lovejoy

[57] ABSTRACT

An animal proof container is set forth. The container comprises a can having a bottom, a sidewall having an inside surface having a plurality of substantially flat portions each having a recess defined thereby, an outside surface having a corresponding plurality of holes communicating to the recesses and a rim defining an open top. A lid of the container has a cover portion adapted to cover the open top of the can and a plurality of members extending downwardly peripherally from the cover portion, fitting adjacent the inside surface of the can and having lower end portions adjacent the flat portions of the inside surface, the lower end portions being biased outwardly towards the flat portions sufficiently to proceed into the recesses when the lid is pushed fully downwardly onto the can. The lid is biased normally upwardly relative to the can sufficiently for preventing the lower end portions from entering the recesses. Food stored in such a container is protected from the attacks of animals, including large animals such as bears. Yet, a human can readily open the container. The container can also be made relatively light in weight.

12 Claims, 3 Drawing Sheets

ANIMAL PROOF CONTAINER

DESCRIPTION

1. Technical Field

The present invention relates to an animal proof container in which food can be safely stored when camping.

2. Background Art

A well know problem when camping out is that animals such as racoons, bears, bluejays, rats, and the like, will break into the campers food supply unless it is somehow kept out of the animals reach. The food supplies can be stored in an automobile or RV when such is near by, but when the camper is far from the protection offered by such vehicles it is nearly impossible to insure that the food is not broken into. Generally, makeshift techniques such as hanging the food in plastic bags from trees, suspending such bags in streams, or the like, are resorted to by the camper. This takes considerable time both when the food is hung up and when it is taken down. And, more aggressive animals, particularly bears which are accustomed to the presence of humans, will sometimes come into the camp in the middle of the day to steal the food.

The present invention is directed to overcoming one or more of the problems set forth above.

DISCLOSURE OF INVENTION

In accordance with the present invention an animal proof container is set forth. The container comprises a can having a bottom, a sidewall having an inside surface having a plurality of substantially flat portions each having a recess defined thereby and an outside surface having a corresponding plurality of holes communicating to the recesses. The can also has a rim defining an open top. A lid having a cover portion which is adapted to cover the open top and a plurality of members extending downwardly peripherally from the cover portion, fitting adjacent the inside surface and having lower portions adjacent the flat portions of the inside surface also forms a part of the container. The lower end portions of the members are biased outwardly towards the flat portions of the inside surface sufficiently to proceed into the recesses when the lid is pushed fully downwardly into the can. Means are provided for biasing the lid normally upwardly relative to the can sufficiently for preventing the lower end portions from entering the recesses.

A container in accordance with the present invention is readily openable by a camper but is substantially impervious to attack by animals. So long as the container is made of reasonably strong material it can readily stand even the battering to which it might be subjected by a large bear. And, with a properly selected material the container can be kept to a relatively light weight whereby it can be readily carried in or attached to a backpack.

BRIEF DESCRIPTION OF DRAWINGS

The invention will be better understood by reference to the figures of the drawings wherein like numbers denote like parts throughout and wherein.

BEST MODE FOR CARRYING OUT INVENTION

Figure 1:
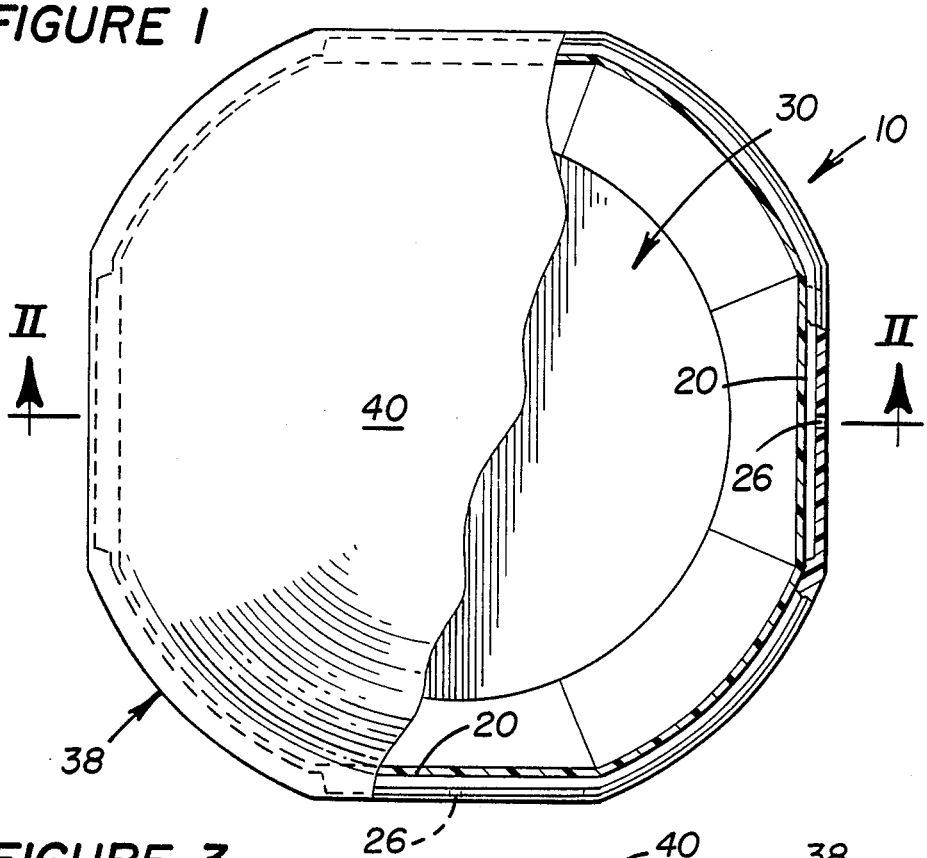
FIG. 1 illustrates, in top view, a container in accordance with an embodiment of the present invention.
Figure 3:
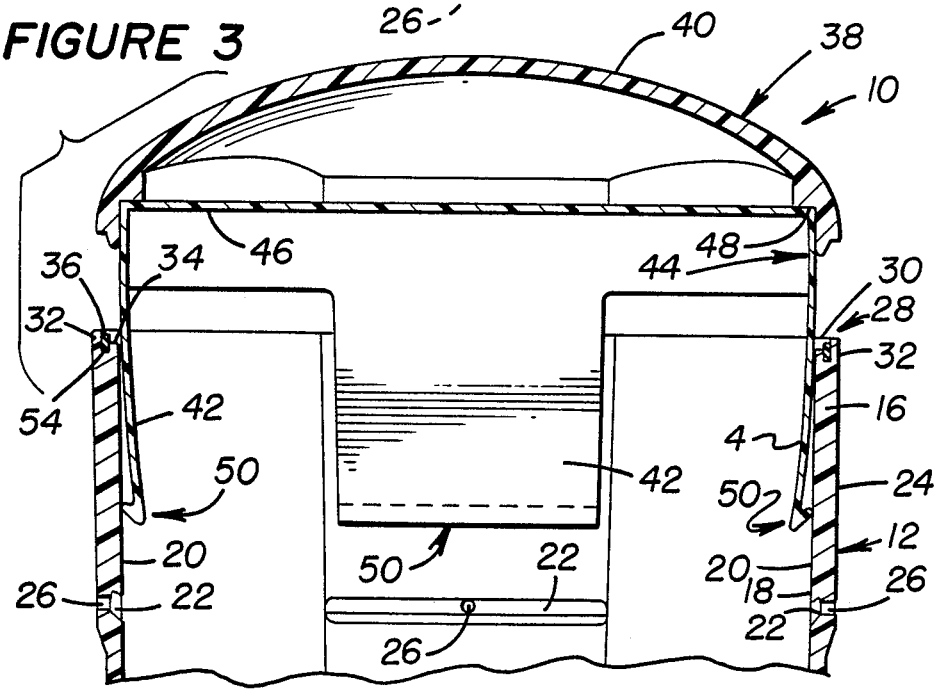
FIG. 3 illustrates, in partial view similar to FIG. 2, the container in a separated state.
Figure 2:
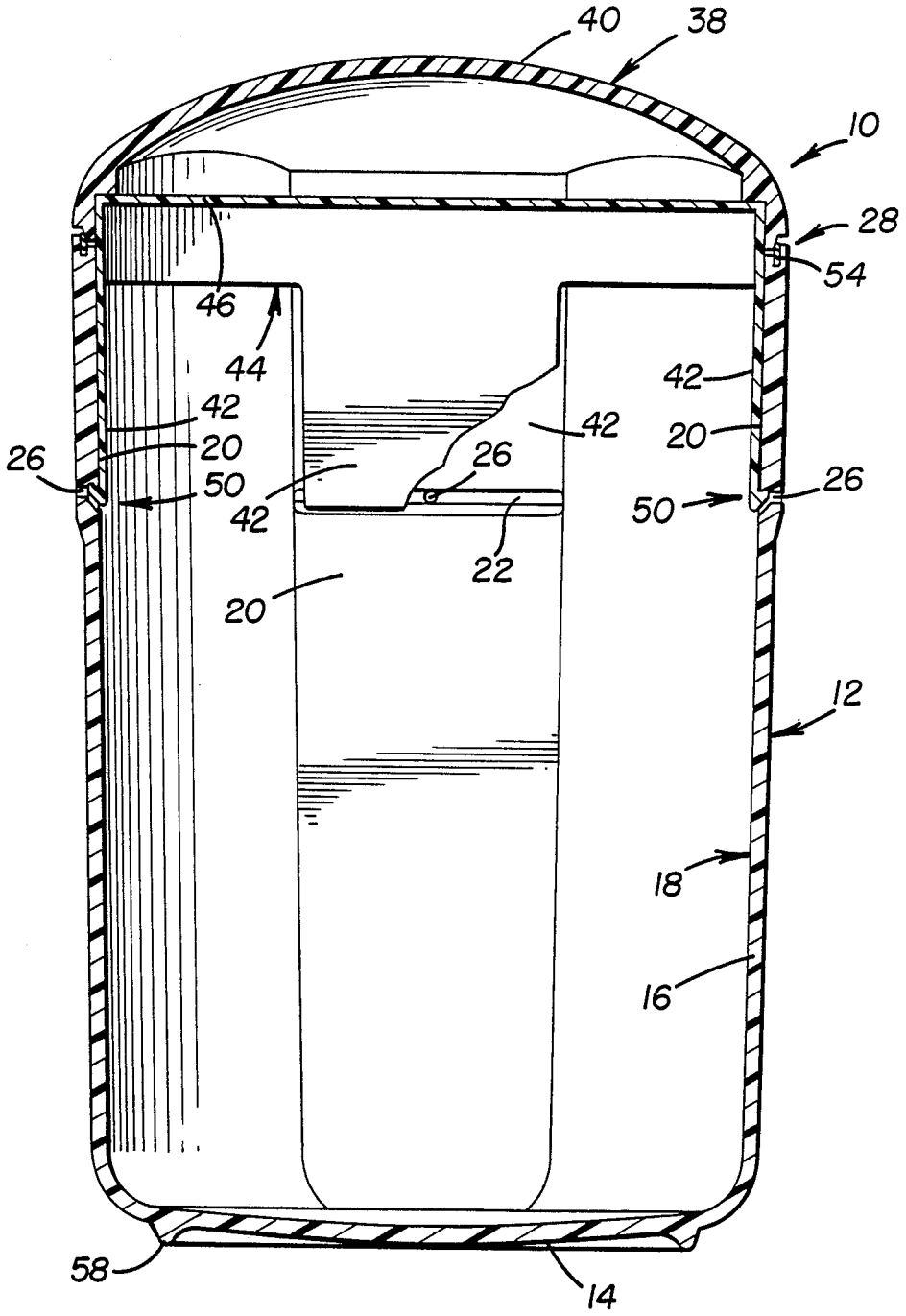
FIG. 2 illustrates, the container of FIG. 1 in side section partially cut away view taken along the line II—II of FIG. 1.
Figure 4:
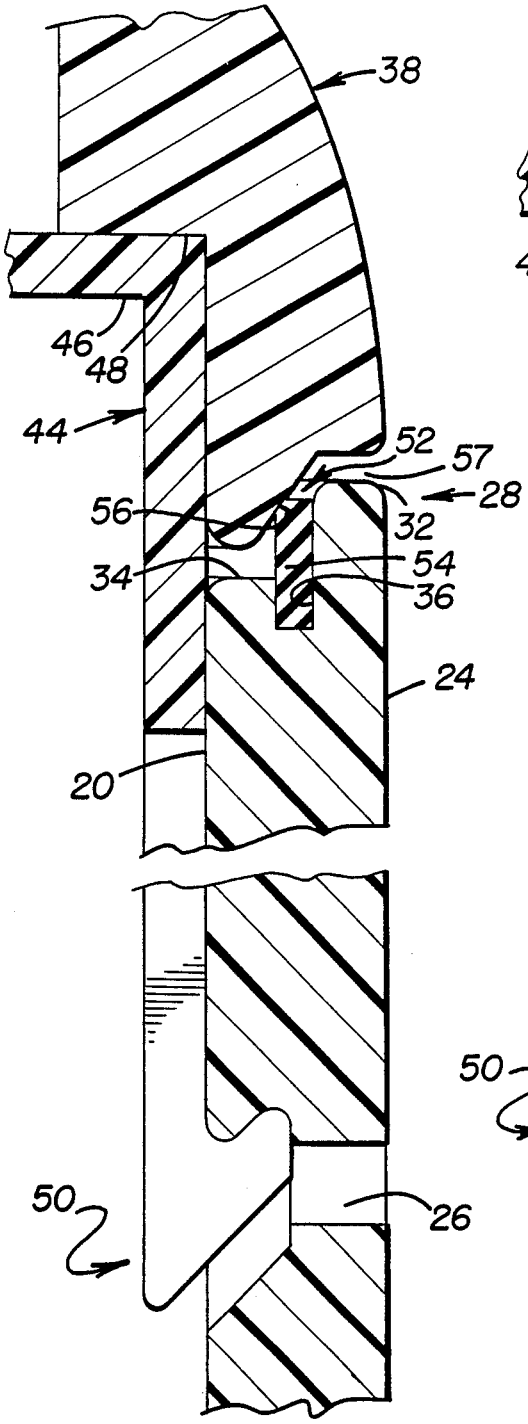
FIG. 4 illustrates a detail in the container as shown in FIG. 2.
Figure 5:
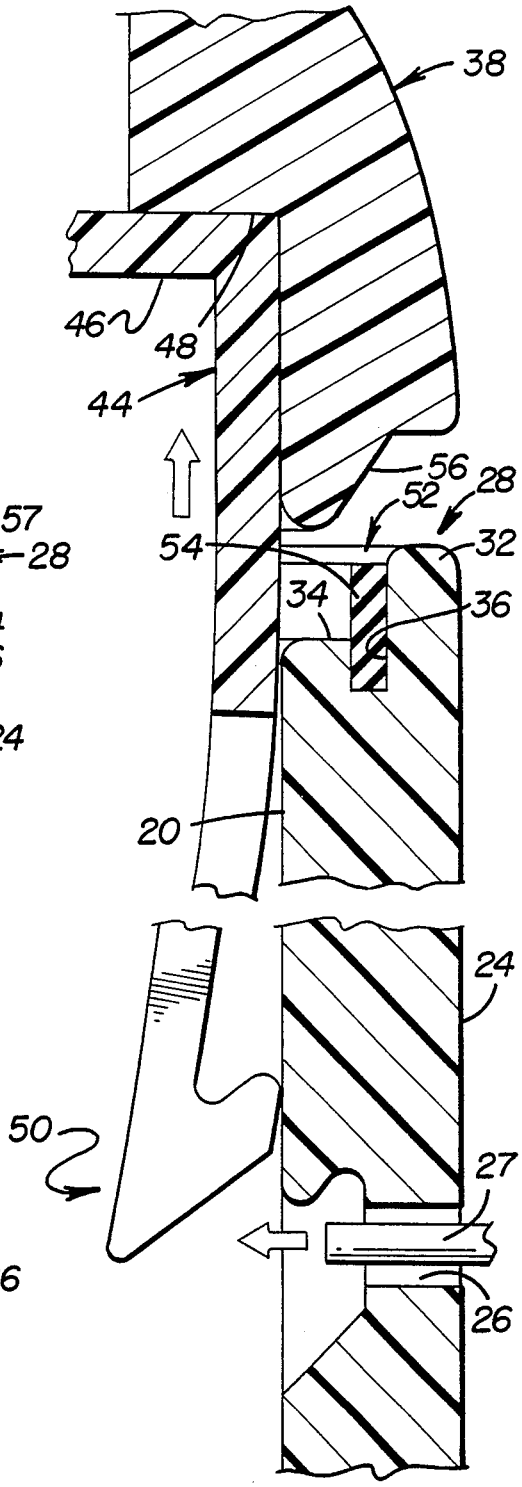
FIG. 5 illustrates the detail of FIG. 4 in a separated state.

In accordance with the present invention an animal proof container 10 is provided as seen in the FIGS. 1–5. The container 10 comprises a can 12 having a bottom 14, a sidewall 16 having an inside surface 18 having a plurality of substantially flat portions 20 each having a recess 22 defined thereby. The can 12 also has an outside surface 24 having a plurality of holes 26, generally one for each recess 22, communicating to the recesses 22. The recesses 22 generally extend laterally generally parallel to the bottom 14 of the can 12. The holes 26 are preferably towards the center of the laterally extending recesses 22 and can be of substantially any desired shape. Generally the holes 26 should be of a size and shape sufficient to permit insertion of a twig, a knife blade, a key, or the like (a small rod 27 is shown in FIG. 5). Also, the holes 22 should be small enough whereby an animal is unlikely to accidentally insert a digit or claw therethrough.

The can 12 has a rim portion 28 which defines an open top 30 thereof. In accordance with the illustrated embodiment of the invention the rim portion 28 of the can 12 has an outer rim portion 32 and an inner rim portion 34 defining between them a gap 36 (see FIGS. 4 and 5). The outer rim portion 32 extends further upwardly than does the inner rim portion 34 for reasons which will be discussed below.

A lid 38 also forms a portion of the animal proof container 10. The lid 38 has a cover portion 40 which is adapted to cover the open top 30 of the can 12. The lid 38 also has a plurality of members 42 extending downwardly peripherally from the cover portion 40. In the particular embodiment illustrated there are four of the members 42.

The lid 38 and the cover portion 40 can be originally unitarily formulated from a single piece of material, perhaps via a sequential molding operation, but it is more convenient to make the lid 38 separately. The downwardly extending members 42 are preferably made as part of an overall crown shaped structure 44 as illustrated in FIGS. 2–5. A top portion 46 of the crown shaped structure 44 then fits within a mating cavity 48 in the cover portion 40 and is joined thereto and made into an integral structure by gluing, welding or the like. In accordance with the invention both the cover portion 40 and the crown shaped structure 44, along with the downwardly extending members 42, are made of a plastic material and may be welded together by techniques such as vibration welding.

The downwardly extending members 42 fit adjacent the inside surface 20 of the can 12 and have lower end portions 50 adjacent the flat portions 20 of the inside surface 18. The lower end portions 50 of the downwardly extending members 42 are biased outwardly towards the flat portions 20 of the inside surface 18 sufficiently to proceed into the recesses 22 when the lid 38 is pushed fully downwardly into the can 12. The biasing of the lower end portions 50 is generally a property of the material of construction of the lid 38, which will generally be of a plastic material, and of the shape of the mold in which the crown shaped structure 44 and the downwardly extending members 42 are molded. The lower end portions 50 of the downwardly extending members 42 are generally shaped to extend parallel to the recesses 22 (see FIG. 3). In accordance with the embodiment illustrated, the lower end portions 50 of the downwardly extending members 42 have a fish-hook shape in cross-section and the recesses 22 are shaped to provide a receptor for the fish-hook shape.

In accordance with the present invention (see principally FIGS. 4 and 5) biasing means 52 are provided for biasing the lid 38 normally upwardly relative to the can 12 sufficiently for preventing the lower end portions 50 of the downwardly extending members 42 from entering the recesses 22. Thus, the biasing means 52 must be overcome, as by pressing downwardly upon the lid 38 (see FIG. 4), in order to allow the lower end portions 50 of the downwardly extending members 42 to proceed into the recesses 22 under the impetus of their own biasing.

When one inserts something, e.g., the rod 27, in any one of the holes 26 and impels the respective lower end portion 50 inwardly of the can 12 and out of the respective recess 22, the biasing means 52 forces the lower end portion 50 upwardly along the respective substantially flat portion 20 so that the lower end portion 50 does not reengage with the recess 22. The user simply repeats this procedure using each of the holes 26 to disengage the corresponding lower end portions 50 from the corresponding recess 22.

The biasing means 52, in accordance with the embodiment illustrated, comprises a compressible gasket 54 positioned between the lid 38 and the rim portion 28 of the sidewall 16. The compressible gasket 54, as illustrated, may partially fit in the gap 36 between the outer rim portion 32 and the inner rim portion 34 of the rim 38. The gasket 54 must be resilient and can be, for example, of an elastomeric material. Alternatively, the gasket 54 can be of another material, for example, a foamed plastic (or foamed elastomeric) material, which will spring back to its original shaped after being compressed. The gasket 54 preferably extends upwardly above the gap 36 to between the upward extensions of the outer rim portion 32 and the inner rim portion 34. The lid 38, in accordance with the embodiment illustrated, includes a slanted portion 56 which is adapted to contact the gasket 54 and to compress the gasket 54 against the outer rim portion 32. In this manner the resulting annular slot 57 defined between the lid 38 and the can 12 can be kept to a minimal size whereby a strong animal such as a bear cannot get its claws into the slot 59 and rip into the container 10.

The container 10 of the present invention can be made of any desired material which has the required strength and which preferably is relatively light in weight. To accomplish this it is generally desirable to use plastic materials for all of the components. To keep the weight down it is desirable to use foamed plastic materials, particularly foamed plastic materials. For example, structural foamed polycarbonate is an excellent material combining properties of strength, ease of construction, the ability to provide built in biasing for the lower end portions 50 of the members 52, and low weight. Other foamed plastic materials can also be used, for example polyurethane foams are useful.

In accordance with the present invention it will be noted that the can 12 has a sidewall 16 which is somewhat octagonal in shape with the sides of the octagonal shape being alternatively circular, flat, circular, flat, etc. The circular shape is preferred for the alternate sides so as to provide strength. The flat shape is used so as to provide the flat portions 20 of the inside surface 18. It should be noted that the bottom 14 is generally continuously formed from the sidewall 16, for strength and ease of construction. For convenience the bottom 14 includes an annular ridge 58 (FIG. 2) which can serve as a support for the can 12. It should further be noted that the portion of the can 12 beneath the recesses 22 can be made somewhat thinner than can that portion of the can 12 above the recesses 22 without any great loss in strength. This is desirable in order to keep the weight of the container 10 to a minimum whereby it can be more easily back packed.

Industrial Applicability

The present invention provides an animal proof container 10 useful for storing food during camping. The animal proof container 10 is easily opened by a human being but is capable of resisting attacks from animals, including bears.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

We claim:

1. An animal proof container, comprising:

a can having a bottom, a sidewall having an inside surface having a plurality of substantially flat portions each having a recess defined thereby and an outside surface having a corresponding plurality of holes communicating to said recess and a rim defining an open top of said can;

a lid having a cover portion adapted to cover said open top of said can and a plurality of members extending downwardly peripherally from said cover portion, fitting adjacent said inside surface and having lower end portions adjacent said flat portions of said inside surface, said lower end portions being biased outwardly toward said flat portions sufficiently to proceed into said recesses when said lid is pushed fully downwardly into said can; and biasing means for biasing said lid normally upwardly relative to said can sufficiently for preventing said lower end portions from entering said recesses.

2. A container as set forth in claim 1, wherein said biasing means comprises a compressible gasket positioned between said lid and said rim of said sidewall.

3. A container as set forth in claim 2, wherein said recesses extend laterally generally parallel to said bottom and wherein said lower end portions extend parallel to said recesses.

4. A container as set forth in claim 3, wherein said lower end portions have a fish-hook shape in cross-section and wherein said recesses provide a receptor for said fish-hook shape.

5. A container as set forth in claim 2, wherein said rim of said can has an outer rim portion and an inner rim portion defining between them a gap, said outer rim portion extending further upwardly than said inner rim portion and wherein said gasket is held partially in said gap.

6. A container as set forth in claim 5, wherein said lid includes a slanted portion adapted to contact said gasket and to compress said gasket against said outer rim portion.

7. A container as set forth in claim 5, wherein said holes are of a size too small to accept any of the digits of a bear.

8. A container as set forth in claim 1, wherein said can and said lid are of a plastic composition.

9. A container as set forth in claim 8, wherein said plastic is a foamed plastic.

10. A container as set forth in claim 8, wherein said plastic is a structural form.

11. A container as set forth in claim 1, wherein said recesses extend laterally generally parallel to said bottom and wherein said lower end portions extend parallel to said recesses.

12. A container as set forth in claim 11, wherein said lower end portions have a fish-hook shape in cross-section and wherein said recesses provide a receptor for said fish-hook shape.

* * * * *